US006854311B2

(12) United States Patent
Schmauder et al.

(10) Patent No.: US 6,854,311 B2
(45) Date of Patent: Feb. 15, 2005

(54) BENDING MACHINE FOR TUBING, BAR AND THE LIKE

(75) Inventors: Frank Schmauder, Metzingen (DE); Winfried Richter, Aichtal-Grötzingen (DE); Jürgen Wolf, Walddorfhäslach (DE); Stephan Lausterer, Pfullingen (DE); Erwin Holder, Bad Urach (DE); Stefan Deuter, Reutlingen (DE); Rainer Hofmann, Gerlingen (DE)

(73) Assignee: Trumpf Rohrtechnik GmbH + Co. KG (DE)

( * ) Notice: Subject to any disclaimer, the term of this patent is extended or adjusted under 35 U.S.C. 154(b) by 41 days.

(21) Appl. No.: 10/404,256

(22) Filed: Apr. 1, 2003

(65) Prior Publication Data

US 2003/0213278 A1 Nov. 20, 2003

(30) Foreign Application Priority Data

Apr. 3, 2002 (EP) ..... 02007294

(51) Int. Cl.[7] ..... B21D 7/024
(52) U.S. Cl. ..... 72/157; 72/149; 72/307
(58) Field of Search ..... 72/149, 159, 157, 72/306, 388, 307, 217

(56) References Cited

U.S. PATENT DOCUMENTS 4,945,747 A 8/1990 Yogo
5,010,758 A * 4/1991 Togoshi ..... 72/157
5,927,126 A 7/1999 Biella
5,946,960 A * 9/1999 Lanticina ..... 72/149
6,185,968 B1 2/2001 Kanamori
6,189,353 B1 2/2001 Kanamori
6,237,380 B1 5/2001 Kanamori

FOREIGN PATENT DOCUMENTS

| | | |
|---|---|---|
| DE | 3620151 | 2/1987 |
| EP | 0446819 | 9/1992 |
| JP | 62267021 | 8/1994 |
| JP | 2001212624 | 8/2001 |

* cited by examiner

*Primary Examiner*—Daniel C. Crane

(57) ABSTRACT

A bending machine for the bending of tube, rod and bar shaped workpieces (24, 24*a*) includes a machine base unit (2), a collet (6) for mounting a workpiece, and a tool assembly (15) with at least one bending tool. The bending tool can be opened and closed in the transverse direction of the workpiece by the relative movement of tool components to form a workpiece holder. The tool assembly (15) is mounted on a swivel support (10) to rotate around a tool axis of rotation (16) extending axially of the workpiece, and the swivel support (10) is mounted on the machine base unit (2) to be rotatable around a swivel support axis of rotation (11) extending in the axial direction (12) of the workpiece. The swivel support axis of rotation (11) and the tool axis of rotation (16), and the tool axis of rotation (16) and the workpiece holder, are radially offset relative to one another.

13 Claims, 12 Drawing Sheets

BENDING MACHINE FOR TUBING, BAR AND THE LIKE

BACKGROUND OF THE INVENTION

This invention relates to a bending machine for the bending of tube, rod- or bar-shaped workpieces and especially of pipes and tubes. Such a bending machine has a base unit equipped with a collet as well as a tool assembly provided with at least one bending tool. The bending tool can be opened and closed in the transverse direction of the workpiece by the relative movement of tool components and forms at least one workpiece holder, and the tool assembly is mounted on and movable relative to a swivel support which is mounted on the machine base unit in such a fashion that it can be rotated around a swivel support axis of rotation extending in the longitudinal direction of the workpiece.

In bending machines of this type, it is necessary for various reasons to move the tool assembly relative to the machine base unit and/or relative to the workpiece held on it. For example, tool assemblies which for multi-level bending applications are equipped with several bending tools mounted one above the other, and they are moved relative to the machine base unit in a fashion so that each tool, as it is to be applied, can individually address the workpiece to be bent. Two-directional bending tool assemblies equipped with at least one bending tool for each bending direction are positioned relative to the machine base unit and to the workpiece held on it in a fashion so that, for each bending direction, the appropriate bending tool can be engaged. Finally, tool assemblies are also used for workpiece handling for which purpose they can be moved relative to the machine base unit.

A bending machine of the general type last mentioned is described in U.S. Pat. No. 5,927,126 granted Jul. 27, 1999. In that prior art design, the swivel support for the tool assembly is constituted of a platen that is mounted on a basic machine frame in a way to permit rotation around an axis that extends in the longitudinal direction of the workpiece. A slide on that platen guides the tool assembly in a linear direction perpendicular to the axis of rotation of the platen. Rotating the platen and linearly moving the slide allows the tool assembly of that earlier design, prior to or following the processing of the workpiece, to be moved into positions in which it can receive from a loading magazine workpieces to be processed using the components of a bending tool or in which these bending tool components can transfer processed workpieces to an unloading station.

The various positions of the tool assembly or of the work holder constituted by its bending tool can in each case be obtained by one single rotary position of the platen that linearly guides the slide of the tool assembly relative to the basic machine frame. For the linear movement of the slide on the platen, a powerful drive unit must be provided. The size of the linear drive system for the slide is a function of the length of travel of the slide and can be relatively bulky.

It is the objective of this invention to provide a novel bending machine which remedies the drawbacks of the prior art design.

It is also an object to provide such a bending machine which enables the forming of consecutive bends in an elongated workpiece without interference from the machine base as the workpiece is manipulated between positions and formed.

SUMMARY OF THE INVENTION

It has now been found that the foregoing and related objects and advantages can be readily attained in a bending machine for the bending of tubes, rods and bars (24, 24*a*), comprising a machine base unit (2); a collet (6) supported thereon for mounting a workpiece; and a tool assembly (15, 15*a*, 15*b*, 15*c*, 15*d*) with at least one bending tool (20; 40, 60; 80, 100; 40*a*, 60*a*). The bending tool (20; 40, 60; 80, 100; 40*a*, 60*a*) opens and closes in the transverse direction of the workpiece by the relative movement of tool components (21, 25; 41, 45; 61, 65; 81, 85; 101, 105) to form at least one workpiece holder (23, 26; 43, 46; 63, 66; 83, 86; 103, 106). A swivel support (10) is mounted on the machine base unit (2) for rotation around a swivel support axis of rotation (11) extending in the longitudinal direction (12) of the workpiece, and the tool assembly (15, 15*a*, 15*b*, 15*c*, 15*d*) is supported on the swivel support (10) for rotation around a tool axis of rotation (16) extending in the longitudinal direction (12) of the workpiece. The swivel support axis of rotation (11) and the tool axis of rotation (16) and the tool axis of rotation (16) and the workpiece holder (23, 26; 43,46;, 63, 66; 83, 86; 103, 106), are radially offset relative to one another.

The swivel support (10) is in the form of a swivel arm and the tool assembly (15*b*, 15*d*) includes multiple bending tools (40, 60; 40*a*, 60*a*) each comprising a bending die (41, 61; 41*a*, 61*a*) and a pressure element (45, 65). The bending dies (41, 61; 41*a*, 61*a*) of different bending tools (40, 60; 40*a*, 60*a*) are positioned one above the other, and each define a different tool plane. Rotation of the tool assembly (15*b*, 15*d*) around the tool axis of rotation (16) and rotation of the swivel support (10) around the swivel support axis of rotation (11), selectively move different bending tools (40, 60; 40*a*, 60*a*) into position for a bending operation.

The tool assembly (15) includes a plurality of bending tools (80, 100) consecutively positioned in the direction of rotation of the tool assembly (15*c*) around the tool axis of rotation (16). Rotation of the tool assembly (15*c*) around the tool axis of rotation (16) and rotation of the swivel support (10) around the swivel support axis of rotation (11) selectively moves different bending tools (80, 100) into position for a bending operation.

The tool assembly (15*c*) may encompass a plurality of bending tools (80, 100) each comprising one bending die (81, 101) and a clamping jaw (85, 105). The bending dies (81, 101) are situated along a axis (82) extending in the transverse direction of the workpiece on both sides of the tool axis of rotation (16). For bending a workpiece with the workpiece mounted in the workpiece holder (83, 86; 103, 106), the bending dies (81, 101) and the clamping jaw or jaws (85, 105) can be rotated or tilted around a neutral axis (82). By rotating the tool assembly (15*c*) around the tool axis of rotation (16) and rotating the swivel support (10) around the swivel support axis of rotation (11), the bending tools (80, 100) located on either side of the tool axis of rotation (16) can be selectively moved into position for a bending operation.

Rotation of the tool assembly (15, 15*a*, 15*b*, 15*c*, 15*d*) around the tool axis of rotation (16) and rotation of the swivel support (10) around the swivel support axis of rotation (11), moves a bending tool (20; 40, 60, 80, 100, 40*a*, 60*a*) into a workpiece pickup position for accepting a workpiece to be processed and/or into a workpiece transfer position for delivering a processed workpiece.

Generally, there is included a first rotary actuator for driving the rotational movement of the swivel support (10) around the swivel support axis of rotation (11) and/or the rotational movement of the tool assembly (15, 15*a*, 15*b*, 15*c*, 15*d*) with at least one bending tool (20; 40, 60, 80, 100, 40*a*,

60*a*) around the tool axis of rotation (16). A second rotary actuator drives the rotational movement of the workpiece (24, 24*a*) clamped in the collet (6) around a workpiece axis of rotation (67) that extends in the longitudinal direction of the workpiece; a drive control for controlling both the rotary tool actuator and the rotary workpiece actuator. The workpiece (24, 24*a*) is placed in a processing position in the associated work holder (23, 43, 63; 83, 103; 43*a*, 63*a*) of a bending tool (20; 40, 60; 80, 100; 40*a*, 60*a*) and the associated work holder (23; 43, 63; 83, 103; 43*a*, 63*a*). When in the processing standby mode, they have a predefined setpoint orientation around the workpiece axis of rotation (67). With the rotary workpiece actuator and the rotary tool actuator controlled by the drive control, the workpiece (24, 24*a*) and the associated work holder (23; 43, 63; 83, 103; 43*a*, 63*a*) can be reoriented in correlated fashion relative to the setpoint orientation concerned when the associated work holder (23; 43, 63; 83, 103; 43*a*, 63*a*) is moved for placing the workpiece (24, 24*a*) in position for processing in the associated work holder (23; 43, 63; 83, 103; 43*a*, 63*a*), and/or when the work holder (23; 43, 63; 83, 103; 43*a*, 63*a*) is moved for removing the workpiece (24, 24*a*) from its processing position in the associated work holder (23; 43, 63; 83, 103; 43*a*, 63*a*), with the orientation of the workpiece (24, 24*a*) being modifiable to the same degree as the orientation of the work holder (23; 43, 63; 83, 103; 43*a*, 63*a*).

The rotary tool actuator and the rotary workpiece actuator enable the associated work holder (23; 43, 63; 83, 103; 43*a*, 63*a*) to be moved relative to the workpiece (24, 24*a*). When the workpiece holder is moved for bringing the workpiece (24, 24*a*) into its processing position in the associated work holder (23; 43, 63; 83, 103; 43*a*, 63*a*). When the workpiece (24, 24*a*) is removed from its processing position in the associated work holder (23; 43, 63; 83, 103; 43*a*, 63*a*) in an operating phase in which the workpiece (24, 24*a*) and the associated work holder (23; 43, 63; 83, 103; 43*a*, 63*a*) are not in contact with each other, the rotary workpiece actuator is controlled by the drive control and an additional reorientation can be superimposed on the reorientation of the workpiece (24, 24*a*), correlated with the reorientation of the work holder (23; 43, 63; 83, 103; 43*a*, 63*a*).

Preferably, there is included a drive control in the form of a programmable computer-based controller (18).

The tool assembly is rotatably mounted on the swivel support and the swivel support is rotatably mounted on the machine base unit with their axes of rotation extending in the same direction. This enables the machine to provide different positions of the tool assembly and thus different positions of the tool holder itself and of the tool holder on the tool assembly, and different rotational relationships between the tool assembly and the swivel support and between the swivel support and the machine base unit.

Thus, the machine offers great flexibility in terms of the movements made by the tool assembly relative to the machine base unit for various functional procedures and also in terms of the orientation of the tool assembly and the swivel support relative to the machine base unit and relative to the workpiece to be processed. For example, the positioning of the swivel support can be adapted to the position of the workpiece in a manner to avoid any collision with the workpiece. When the tool assembly is suitably balanced relative to the axis of rotation of the tool, the rotational movement of the tool assembly requires only a drive system of limited power and small dimensions, provided by a small sized electric drive system. Similarly, guiding the tool assembly during its rotational movement is possible with structurally simple and space-saving elements. The bending tools of the tool assemblies may be of different designs. These may include for instance bending tools for uncoiled blank bending and/or for coil bending.

The swivel support is constituted of a swivel arm which, appropriately dimensioned, ensures the necessary reach of the tool assembly it supports notwithstanding the simplicity of its implementation. Moreover, a swivel arm of that type has a relatively small intrinsic weight and is a structural element of relatively small bulk. The swivel arm covers only part of the machine base unit.

As described above, the rotatability of the tool assembly relative to the swivel support and the rotatability of the swivel support relative to the machine base unit are utilized for selectively moving bending tools at different tool operating planes into position for a bending operation.

The rotary mounting of the tool assembly and of the swivel support is utilized for selectively moving consecutive bending tools in the direction of rotation of the tool assembly around the axis of rotation of the tool into a position in which they can perform the bending operation on the workpiece concerned. Workpieces can be selectively bent in different directions without requiring an external tool change.

The tool assembly is also used for picking up workpieces to be processed and/or for transferring workpieces that have been processed. A corresponding rotary movement of the swivel support and the tool assembly allows the latter to be placed in the workpiece pick-up position and, once a workpiece to be processed has been picked up, to be moved into a position for the bending operation in which position the workpiece picked up by the tool assembly can be clamped in place in the work holder on the machine base unit. Following one or several subsequent bending operations, the processed workpiece can be unloaded from the bending machine by an appropriate movement of the tool assembly into a workpiece transfer position.

The kinematics are derived from the principle of two axes of rotation in this invention, and the movement of a collet in the workpiece holder relative to the workpiece mounted in the work holder. The changes in the orientation of the workpiece and the collet ensure that the workpiece reliably arrives in its processing position in the appropriate collet with the predefined orientation. Equally reliable is the removal of the workpiece from the collet upon completion of the processing operation.

Preferably, the reorientation of the workpiece associated with the reorientation of the collet can be superimposed by an additional reorientation function. This superposition allows for the orientation required for subsequent workpiece processing simultaneously with the mutually coupled, coordinated reorientation of the workpiece and the collet, thus optimizing the throughput time of the workpiece processing.

BRIEF DESCRIPTION OF THE ATTACHED DRAWINGS

The following describes implementation examples of this invention in more detail with reference to highly simplified schematic illustrations in which—

DETAILED DESCRIPTION OF THE ILLUSTRATED EMBODIMENT

Figure 1:
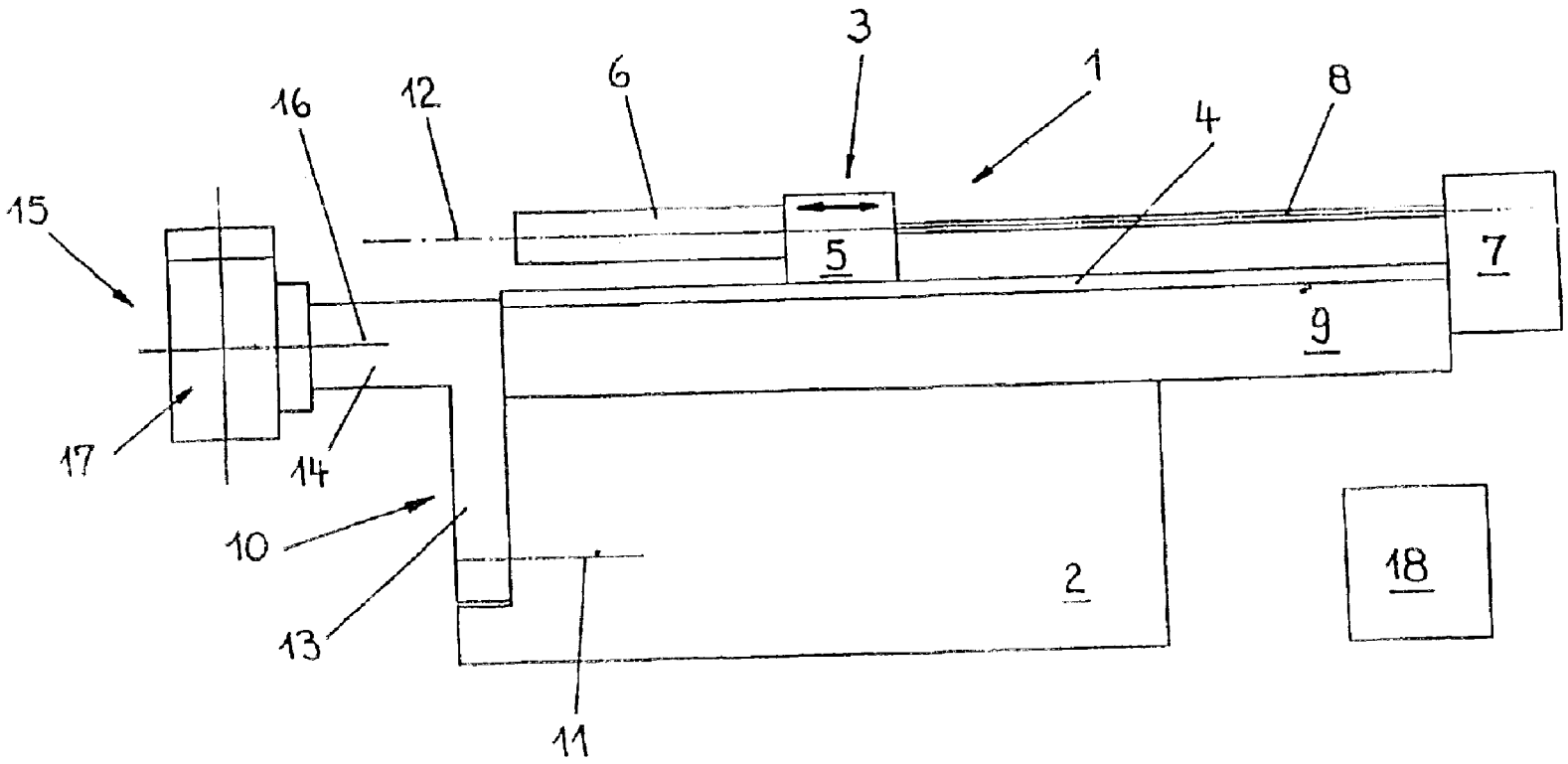
FIG. 1 is a side elevational view of the basic configuration of a bending machine embodying the present invention and including the machine base unit, the swivel support and the tool assembly.

As shown in FIG. 1, a bending machine, here a pipe bending machine 1, encompasses a machine base unit 2 equipped with various functional units. On its top the machine base unit 2 supports a workpiece feed mechanism 3 with a feed slide 5 that can travel along guide bars 4 on the machine base unit 2. For workpieces to be processed, the feed slide 5 is provided with a work holder in the form of a collet 6 that can be opened and closed in controlled fashion and that can be rotated around its axis. The machine base unit 2 also supports a mandrel drive 7 from which protrudes a mandrel bar 8. Mounted on the front end of the mandrel bar 8 in conventional fashion is a mandrel (not illustrated). In the embodiment of FIG. 1, the mandrel drive 7 sits on a rearwardly cantilevered portion 9 of the machine base unit 2.

At the opposite end, the machine base unit 2 supports a swivel support 10 which, in the case of the embodiment shown, is in the form of an angled swivel arm. The swivel support 10 can be rotated relative to the machine base unit 2 around a swivel support axis of rotation 11. This swivel support axis of rotation 11 extends in a longitudinal direction 12 of the workpiece, as indicated by a dot-dash line in FIG. 1.

A radial swivel support leg 13 extends in a perpendicular direction relative to the swivel support axis of rotation 11 and serves to connect the swivel support 10 to the machine base unit 2 while a tool assembly 15 is mounted on a swivel support leg 14 that extends parallel to the swivel support axis 11. The tool assembly 15 mounted on the swivel support 10 can be rotated around a tool axis of rotation 16. The tool axis of rotation 16 extends in the longitudinal direction 12 of the workpiece and thus parallel to the swivel support axis of rotation 11 relative to which the tool axis of rotation 16 is radially offset.

Components of the tool assembly 15 include bending tools, (not illustrated in FIG. 1), which are mounted on a tool holder 17 at a radial distance from the tool axis of rotation 16. All functional operations of the pipe bending machine 1 are controlled by a programmable computer-based controller 18. All movements of the pipe bending machine 1 are motorized and effected by electric motor drives.

The bending tools (not shown in FIG. 1) used in the pipe bending machine 1 are conventional in design.

A tool assembly 15*a* is illustrated in FIGS. 2 to 13 and has a single bending tool generally designated by the numeral 20 for pipe processing. One component of the tool is the usual bending die 21 which is mounted on the tool holder 17*a* of the tool assembly 15*a*, and it can rotate around an axis 22. Over part of its circumference, the bending die 21 features an arcuate channel 23 whose cross section matches the cross section of the workpieces, i.e., pipes 24 to be bent.

Associated with the bending die 21 as another component of the bending tool 20 is a pressure element in the form of a clamping jaw 25 which has an arcuate channel 26 a cross section cooperating with that of the pipes 24. By means of a clamp drive (not shown), the clamping jaw 25 can be moved in the direction of the double arrow 27 relative to the bending die 21 for opening and closing the bending tool 20. At the same time the clamping jaw 25 can be rotated around the axis 22 by the swivel arm 28 of the tool holder 17*a*. When the bending tool 20 is closed, the arcuate channels 23, 26 of the bending die 21 and of the clamping jaw 25 constitute a tool holder with a recess of essentially circular cross section in which a pipe 24 is clamped.

As shown in FIGS. 2 to 13, the tool assembly 15*a* and the bending tool 20 can be employed not only for bending the pipes 24 but also for manipulating the pipes 24.

Figure 2:
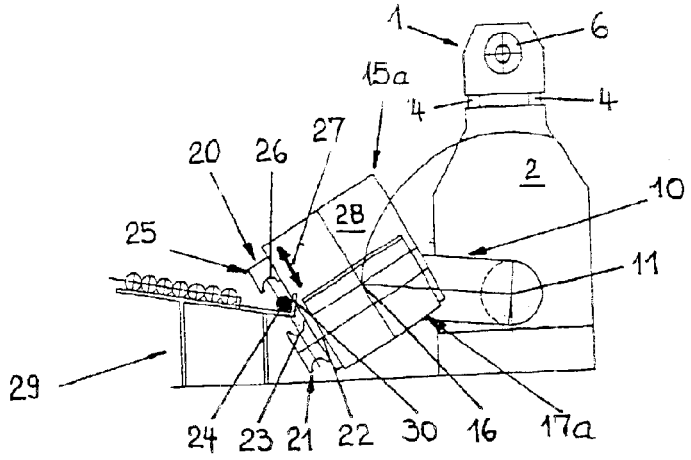
FIGS. 2 to 6 are front elevational views of the bending machine of FIG. 1 with a first tool assembly as it receives a workpiece to be processed.

In the operating or bending phase shown in FIG. 2, a pipe 24 is separated from a loading magazine. The pipe 24 thus separated abuts the stop bracket 30 of the loading magazine 29 on the side of the machine. The bracket, viewed from the plane of projection in FIG. 2, extends perpendicularly over only a short section of the pipe 24. On the side of the stop bracket 30, the pipe 24 lies exposed. It is there that the tool assembly 15*a* with the open bending tool 20 is located. The swivel support 10 is in a suitably rotated position around the swivel support axis of rotation 11, and the tool assembly 15*a* is in a correspondingly rotated position around the tool axis of rotation 16.

Figure 3:
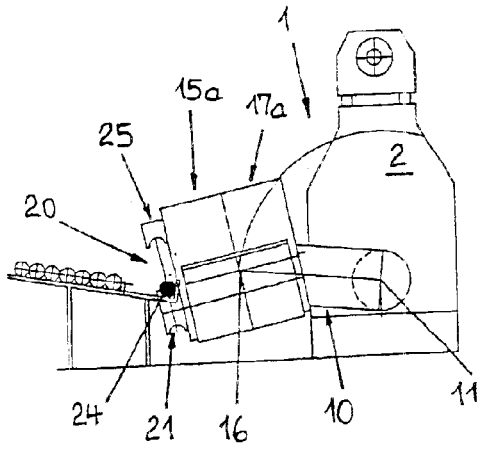
Figure 4:
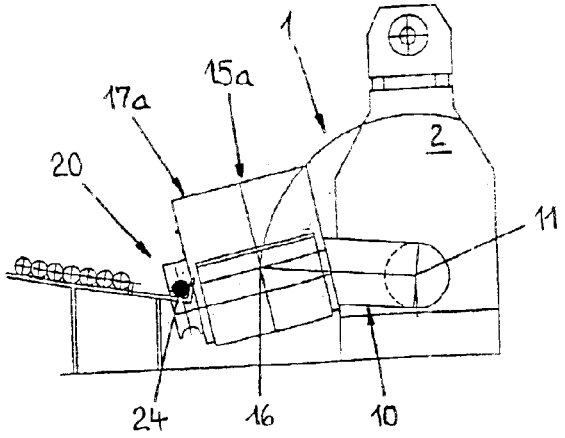

From the position of the parts shown in FIG. 2, the tool assembly 15*a* is rotated clockwise around the tool axis of rotation 16 until the separated pipe 24 is positioned in the arcuate channel 23 of the bending die 21 As seen in FIG. 3. Next, moving the clamping jaw 25 closes the bending tool 20. The pipe 24 is now contained and clamped inside the work holder constituted of the arcuate channels 23, 26 as seen in FIG. 4. By turning the tool assembly 15*a* with the pipe 24 clamped in it around the tool axis of rotation 16 and turning the swivel support 10 around the swivel support axis of rotation 11, the assembly is moved into a position in which the end of the pipe 24 facing the machine is positioned opposite the open collet 6 of the workpiece feed mechanism 3.

Figure 5:
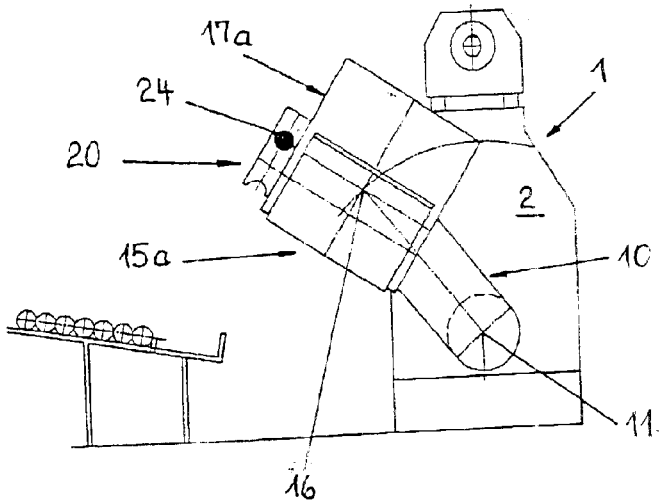
Figure 6:
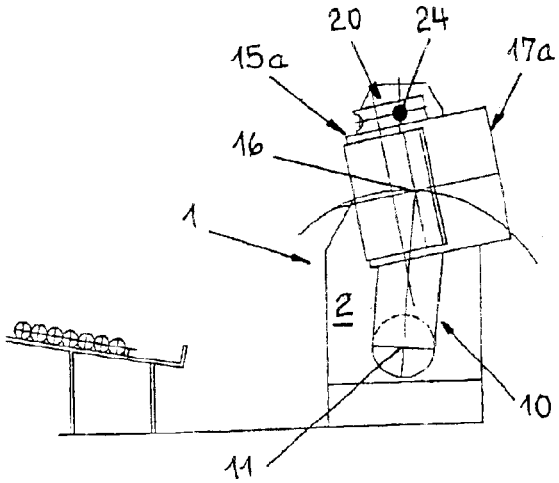
Figure 7:
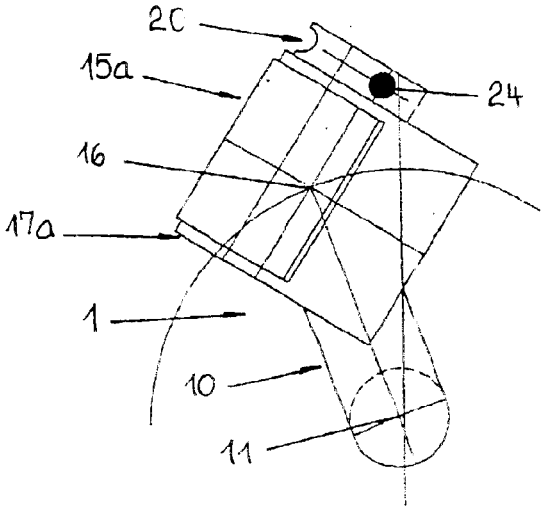
FIG. 7 is identical to FIG. 6 except that it depicts the tool assembly and swivel support in a different orientation than that in FIG. 6.
Figure 8:
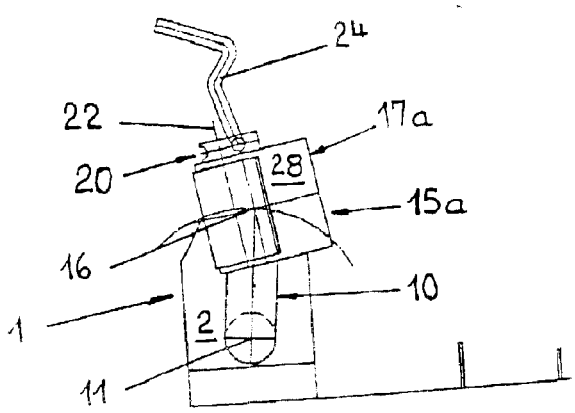
FIGS. 8 to 13 are front elevational views of the bending machine of FIGS. 1 to 7 as it delivers a processed workpiece to a discharge position.

FIG. 5 shows the pipe 24 in an intermediate position. FIG. 6 shows it in its final position. In the illustration of FIG. 6, the swivel support 10 is angled to the right, and the tool assembly 15*a* is rotated counterclockwise. As an alternative to this orientation of the swivel support 10 and the tool assembly 15*a*, the tool assembly 15*a* and the swivel support 10 may also be oriented as shown in FIG. 7. The positioning of the pipe 24 in FIG. 7 is identical to its positioning according to FIG. 6. This means that different kinematics can be employed in moving the pipe 24, i.e., the work holder provided by the arcuate channels 23, 26 into the same position.

For exactly the same position of the pipe 24, the tool assembly 15*a* and the swivel support 10 can be set up in different ways. This in turn makes it possible to adapt the positioning of the tool assembly 15*a* and of the swivel support 10 to the configuration of the pipe 24 at the forward end of the pipe bending machine 1. If, for example, the pipe 24 as it is processed is bent toward the machine base unit 2, the swivel support 10 can be reoriented so that a collision between it and the pipe 24 is avoided. Overall, it is possible to place the interference field created by the tool assembly 15*a* and/or the swivel support 10 in such a fashion that the pipe 24 will be positioned outside this interference field, thus eliminating any possible obstruction in the workpiece processing.

The bending process itself can take place without any collision between the workpiece and the machine, but so can the preceding and/or following alignment of the pipe in the direction of its circumference as the collet 6 is turned around its axis. This latter aspect is particularly important when producing multiple bends in the same workpiece, i.e., in cases where one or several bends already produced on a workpiece must be kept outside the interference field on the machine side as the workpiece is being manipulated. In summary, the kinematic concept of the pipe bending machine 1, described above, provides substantial freedom in the configuration of machine bent pipes and especially those with multiple bends. All of the procedural steps are controlled by the programmable computer-based controller 18.

Once the pipe 24 to be processed is in the position depicted in FIGS. 6 and 7, the feed slide 5 of the workpiece feed mechanism 3 moves under computer control up to the pipe 24 to where its end on the machine side is positioned inside the open collet 6. Again under computer control, the collet 6 is then closed and the machine-side end of the pipe 24 is locked in place on the workpiece feed mechanism 3.

This is followed by several conventional bending operations. For each bending operation, the swivel arm 28 with the clamping jaw 25 rotates around the axis 22 while, at the same time, the bending die 21 rotates around the axis 22. In the process, the pipe 24, clamped between the bending die 21 and the clamping jaw 25, follows that movement and is bent. After each individual bending operation, the bending tool 20 is opened while the workpiece feed mechanism 3 advances the pipe 24 in the longitudinal direction 12 of the workpiece. During that advance in the longitudinal direction 12 of the workpiece, the pipe 24 is turned, if and as needed, by a controlled rotation of the collet 6 around the longitudinal directional axis 12 of the workpiece. On completion, the processed pipe 24 has the shape illustrated in FIG. 8.

When the swivel arm 28 of the tool holder 17*a* is swiveled back into its home position and the bending tool 20 remains closed, the bent pipe 24 is locked in place in the tool assembly 15*a*. Next, the collet 6 is opened and, as the feed slide 5 is moved in the direction of the rearwardly cantilevered portion 9 of the machine base unit 2, the machine side end of the pipe 24 is released.

Figure 9:
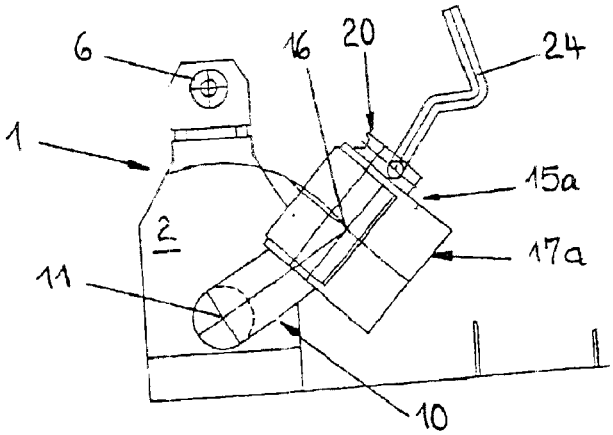
Figure 10:
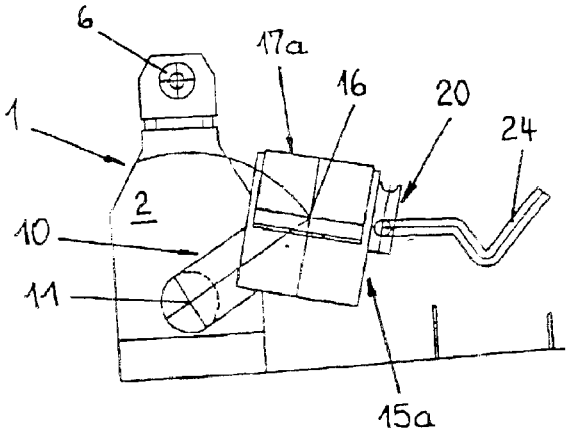

Following that operation, the tool assembly 15*a* holding the pipe 24 can be rotated around the tool axis of rotation 16 while the swivel support 10 is rotated around the swivel support axis of rotation 11. This moves the tool assembly and pipe into a workpiece transfer position illustrated in FIGS. 11 and 12. Preceding intermediate positions of the tool assembly 15*a* are shown in FIGS. 9 and 10.

Figure 11:
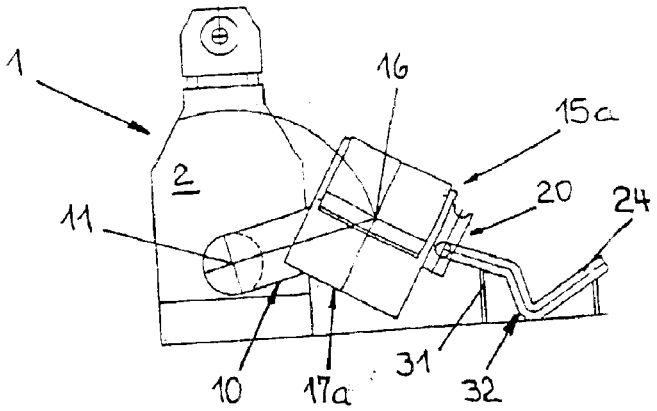
Figure 12:
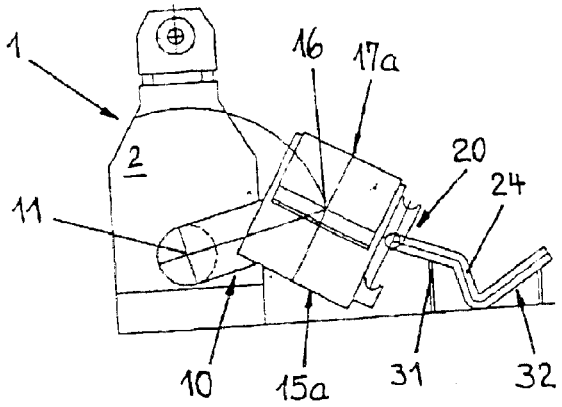
Figure 13:
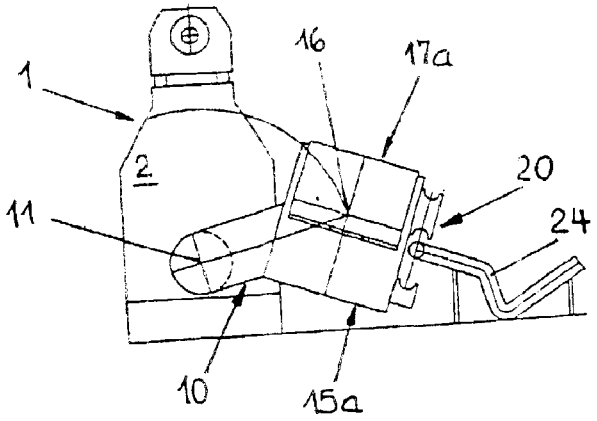

In its workpiece transfer position shown in FIG. 11, with the bending tool 20 still closed, the pipe 24 is placed on the workpiece collector 31 of an unloading station 32. After the bending tool 20 is opened as shown in FIG. 12, the tool assembly 15*a* can again be rotated around the tool axis of rotation 16 while the swivel support 10 is rotated around the swivel support axis of rotation 11 and can be moved away from the deposited pipe 24 as shown in FIG. 13, and back into the position shown in FIG. 2. The system is now ready for another operating cycle of the type described.

When one single bending tool 20 is used, the tool assembly 15*a* shown in FIGS. 2 to 13 is capable of bending pipes with one uniform bending radius only. However, a tool assembly 15*b* as depicted in FIGS. 14 to 21 can bend pipes in various ways without any external tool change.

Figure 14:
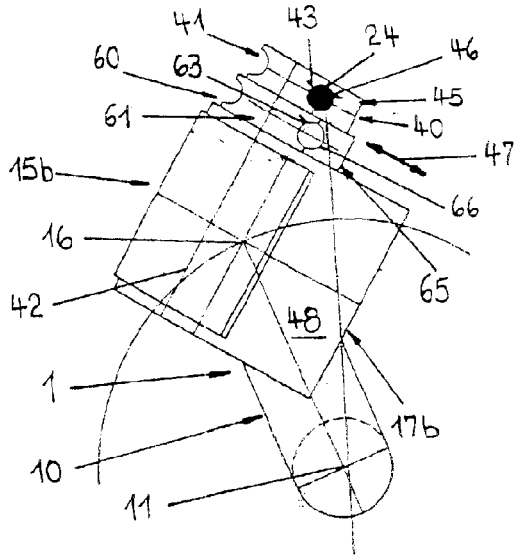
FIGS. 14 to 20 are front elevational views of the bending machine of FIG. 1 but having a tool assembly with a second, multi-level tool assembly and showing the components as the tool assembly changes levels.

To that effect, the tool assembly 15*b* in FIG. 14 is designed as a multi-level unit and equipped with two bending tools 40, 60, one above the other, and each defining a different workpiece plane. The functional components of the bending tool 40 include a bending die 41 and an associated clamping jaw 45; those of the bending tool 60 include a bending die 61 and a clamping jaw 65. For processing a pipe 24, the bending dies 41, 61 can be rotated around one common neutral axis 42 while the clamping jaws 45, 65 can be rotated jointly with the swivel arm 48 of a tool holder 17*b* around the axis 42. For opening and closing the bending tools 40, 60 the clamping jaws 45, 65 can be moved on the swivel arm 48 in the direction of the double arrow 47.

By using the pair of bending tools 40, 60, bends with varying radii of curvature can be produced.

FIG. 14 shows the tool assembly 15*b* in an operating phase of the machine in which the bending tool 40 is in the bending mode on the pipe 24. At this point the pipe 24 is clamped in a work holder constituted of am arcuate channel 43 in the bending die 41 and a tubular channel 46 in the clamping jaw 45. The pipe 24 can be bent by moving the swivel arm 48 around the axis 42.

Another work holder on the tool assembly 15*b* consists of an arcuate channel 63 in the bending die 61 and an arcuate channel 66 in the clamping jaw 65. In the operating state illustrated in FIG. 14, the cylindrical work holder defined by the channels 63, 66 is idle.

Figure 15:
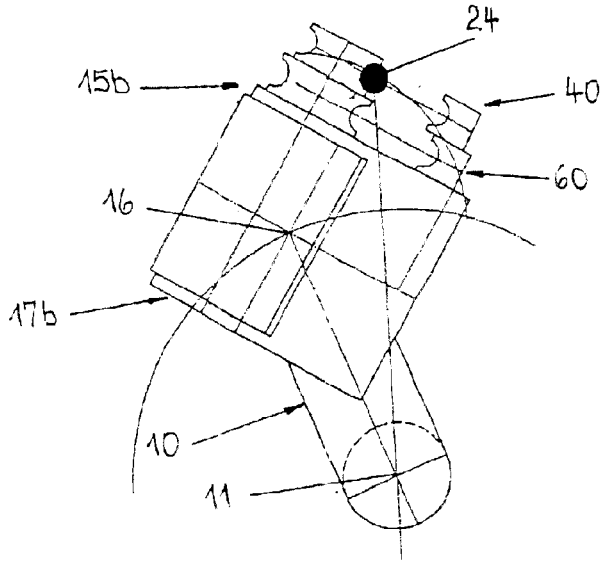
Figure 16:
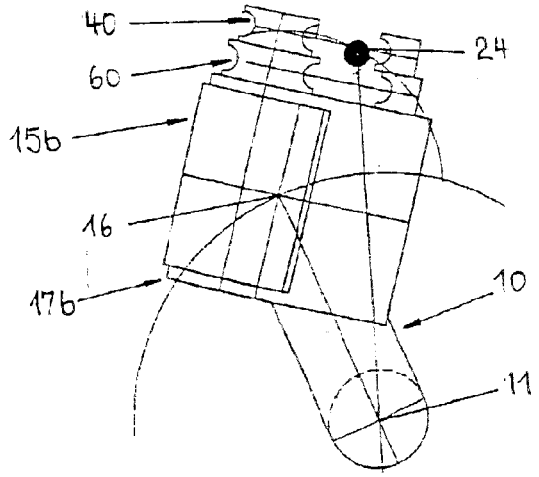
Figure 17:
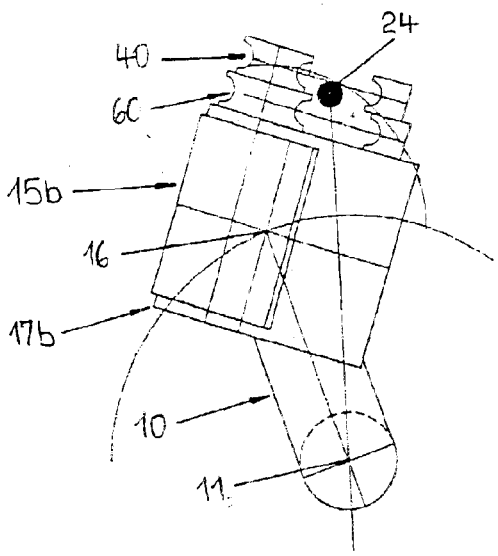
Figure 18:
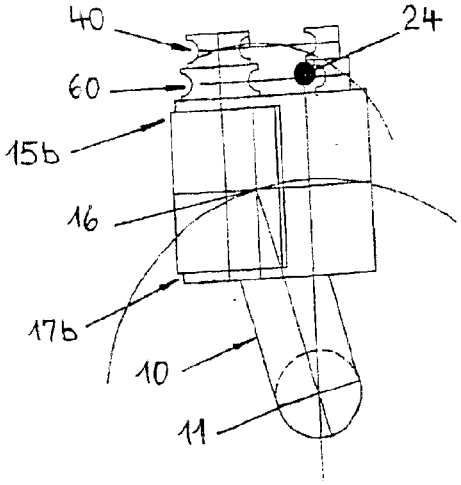
Figure 19:
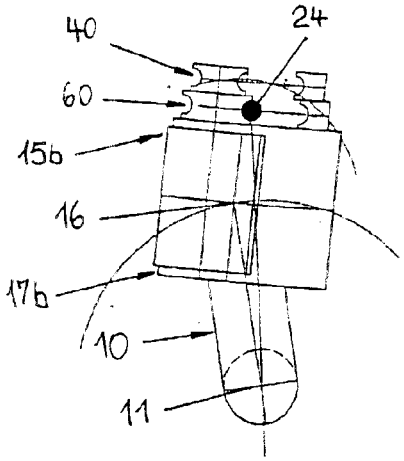
Figure 20:
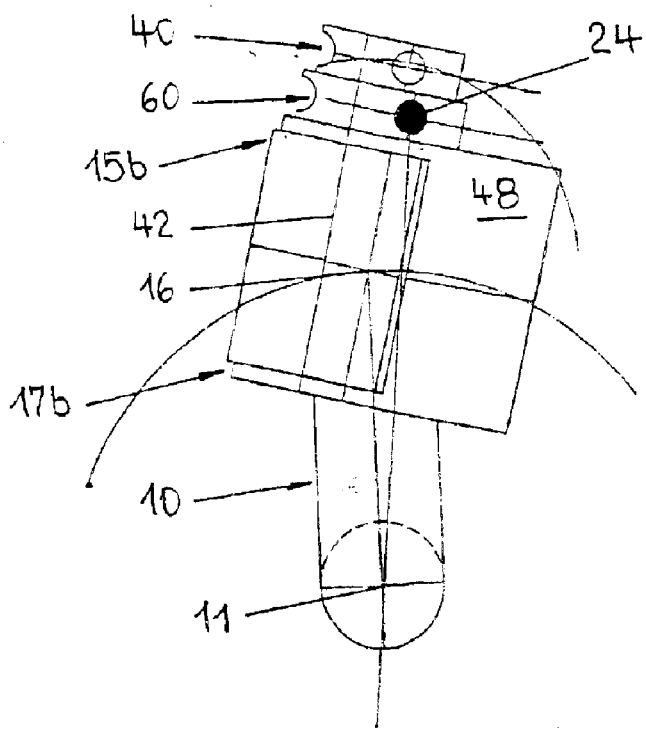

If, for example, the pipe 24 which is already bent with the bending tool 40 is also to be bent by the bending tool 60, it is first necessary to open the bending tool 40 as seen in FIG. 15. This will automatically open the bending tool 60 as well. Next, by turning the tool assembly 15*b* around the tool axis of rotation 16 and the swivel support 10 around the swivel support axis of rotation 11, the bending tool 60 is moved into position for a bending operation. FIG. 20 shows this bending position with the bending tool 60 already closed. Intermediate positions preceding that operating state are illustrated in FIGS. 16 to 19.

In FIG. 20 the tool assembly 15*b* is tilted clockwise around the tool axis of rotation 16, and the swivel support 10 is tilted counterclockwise relative to the vertical line. A corresponding functional bending position of the bending tool 60 can be obtained with the orientation of the tool assembly 15*b* and the swivel support 10 shown in FIG. 21. The position of the work holder 63, 66 of FIG. 20 is identical to the position of the work holder 63, 66 in FIG. 21.

Figure 21:
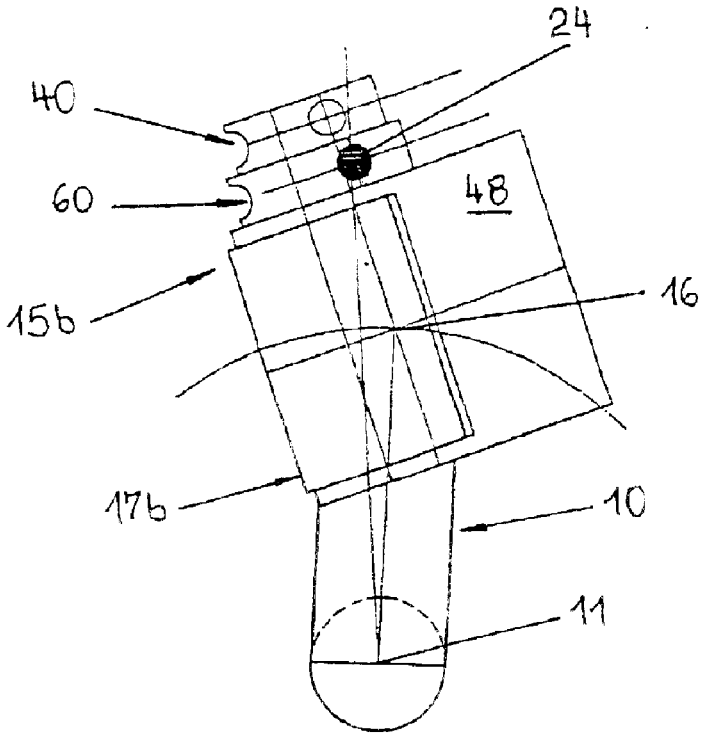
FIG. 21 is identical to FIG. 20 except for a different orientation of the tool assembly and swivel support.

When, with the starting positions shown in FIG. 20 or in FIG. 21, the swivel arm 48 of the tool holder 17*b* is rotated around the axis 42 while at the same time turning the bending dies 41, 61, the pipe 24 will be subjected to a bend with a radius of curvature that is greater than the radius of curvature of the bend obtained earlier with the bending tool 40.

FIGS. 22 to 30 illustrate a tool assembly 15*c*by means of which it is possible to bend pipes 24 in two opposite directions without requiring an external tool change. The tool holder 17*c* of the tool assembly 15*c*is equipped on both sides of the tool axis of rotation 16 with two bending tools

80, 100. Bending dies 81, 101 of the bending tools 80, 100 are situated on one common axis 82. A swivel arm 88, rotatable around the axis 82, supports the clamping jaw 85 of the bending tool 80 on mutually opposite sides as well as the clamping jaw 105 of the bending tool 100. The clamping jaw 85 can be moved relative to the bending die 81 in the direction of the double arrow 87, and the clamping jaw 105 is movable relative to the bending die 101 in the direction of the double arrow 107. The arcuate channels 83, 86 on the bending die 81 and the clamping jaw 85, respectively, and the arcuate channels 103, 106 on the bending die 101 and the clamping jaw 105, respectively, constitute work holders in which the pipe 24 can be locked in position.

Figure 22:
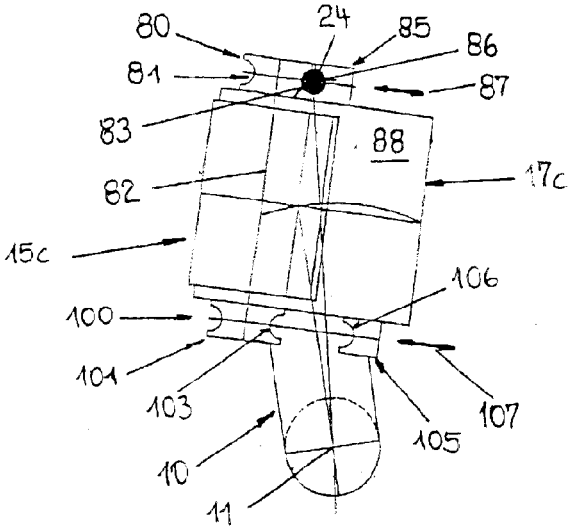
FIGS. 22 to 29 are front elevational views of the bending machine of FIG. 1 with a different, two-directional tool assembly as it changes the bending direction.

FIG. 22 shows the tool assembly 15*c* in an operating phase in which the bending tool 80 is in position for a bending operation. Rotating the swivel arm 88 with the clamping jaw 85 while at the same time turning the bending die 81 around the neutral axis 82 will bend the pipe 24 to the right.

Figure 23:
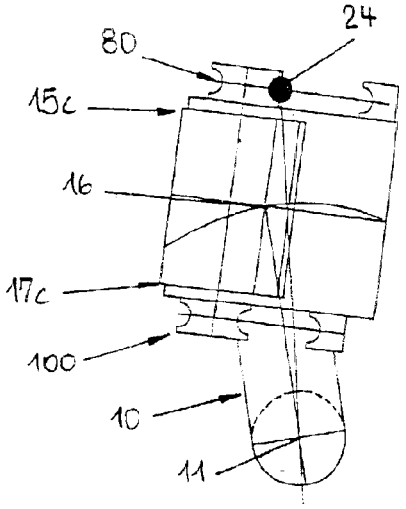
Figure 24:
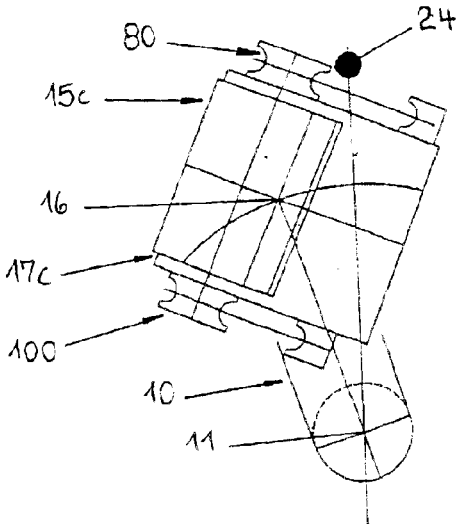
Figure 25:
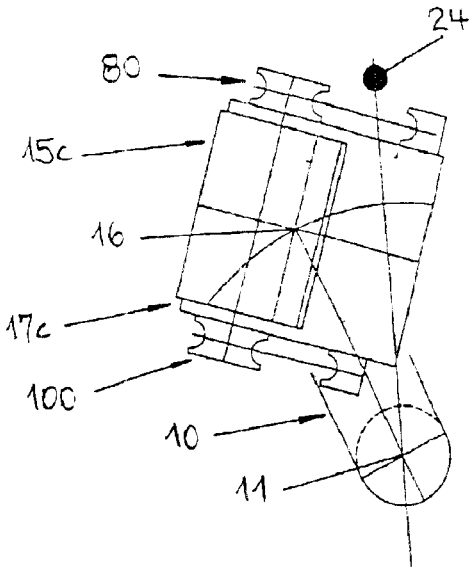
Figure 26:
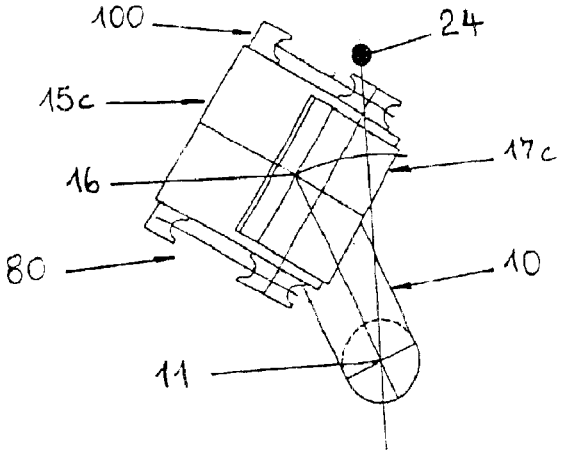
Figure 27:
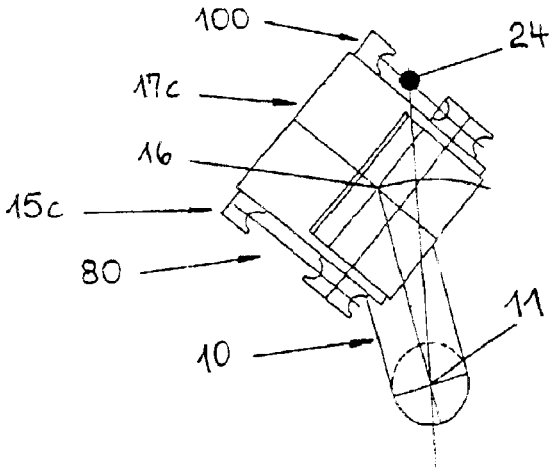
Figure 28:
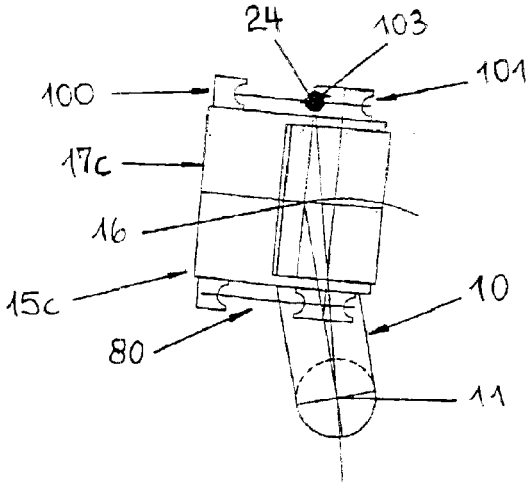

Now, if, for example, the same pipe 24 is to be bent to the left as well, the bending tool 100 must be brought into position for the bending operation. To that effect, based on the conditions of FIG. 22, it is necessary first to open the bending tool 80 as seen in FIG. 23. Next, in matched fashion, the tool assembly 15*c* is rotated around the tool axis of rotation 16 and the swivel support 10 is rotated around the swivel support axis of rotation 11 until the pipe 24 is positioned in the arcuate channel 103 of the bending die 101 of the bending tool 100 as seen in FIGS. 23 to 28. This leaves as the only remaining step the closing of the bending tool 100 by moving the clamping jaw 105, which results in the condition shown in FIG. 29. The bending tool 100 will be in a corresponding bending position as shown in FIG. 30. What has changed compared to FIG. 29 is the orientation of the tool assembly 15*c* and that of the swivel support 10.

Figure 29:
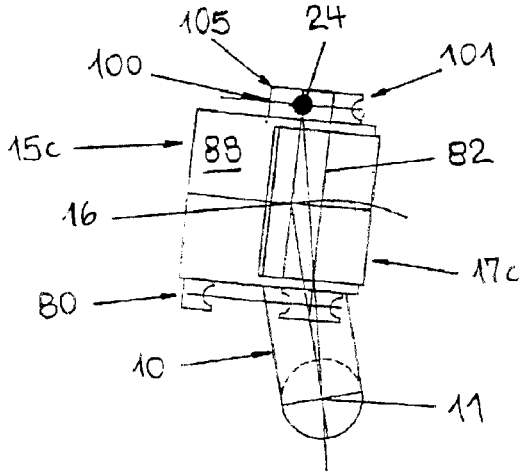
Figure 30:
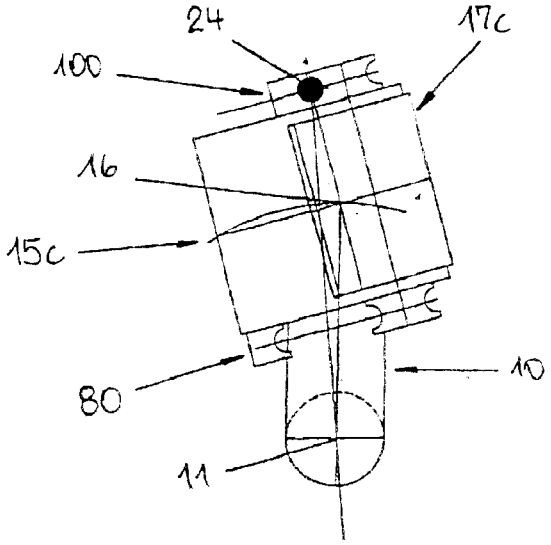
FIG. 30 is identical to FIG. 29 except for a different orientation of the tool assembly and swivel support.

When, from the positions shown in FIG. 29 or FIG. 30, the swivel arm 88 is rotated around the axis 82 while turning the bending die 81, the pipe 24 will be bent to the left.

In addition to left and right bending operations, the tool assembly 15*c* can also be used for handling workpieces, i.e. picking up pipes 24 to be processed and delivering processed pipes 24. The tool assembly 15*b* of FIGS. 14 to 21 can be utilized in analogous fashion, in addition to multi-level bending operations. It is also possible to provide tool assemblies equipped with bending tools on both sides of the tool axis of rotation, in which case several bending tools are mounted at least on one side of the tool axis of rotation, forming different tool reference planes. At that point, one and the same tool assembly permits workpiece handling, multi-level bending and left/right bending.

Operationally proper orientation of the pipes 24 in the longitudinal direction 12 of the workpiece is effected for all processing steps by a workpiece rotating actuator with the collet 6 rotation controlled by the computer-based controller 18. In addition to the individually described tool components, the bending tools 20, 40, 60, 80, 100 include all the usual ancillary components such as slide rails and/or a smoothing tool. For the workpiece processing, the mandrel bar 8 of the pipe bending machine 1 is used in traditional fashion.

FIGS. 31 to 34 are highly simplified schematic design illustrations essentially corresponding to those in FIGS. 14 to 21. A tool assembly 15*d*in the form of a multi-level unit is equipped with two conventional rotary bending tools 40*a*, 60*a* mounted one above the other. For simplicity's sake, FIGS. 31 to 34 show only the bending dies 41*a*, 61*a* of the bending tools 40*a*, 60*a*. The channels 43*a*, 63*a* of the bending dies 41*a*, 61*a* have a rectangular cross section matching the rectangular cross section of the workpiece to be processed, that being pipe 24*a*. Together with the tool holder 17*d*, the tool assembly 15*d* is linked to the swivel support 10 and can be rotated around the tool axis of rotation 16. The swivel support 10, rotatable around the swivel support axis of rotation 11, is mounted on the machine base unit 2 of the pipe bending machine(not shown). By a motorized tool rotation actuator, the swivel support 10 can be rotated around the swivel support axis of rotation 11 and the tool assembly 15*d* can be rotated around the tool axis of rotation 16.

The machine side end of the pipe 24*a* is locked in the collet 6 of the pipe bending machine. In usual fashion the collet 6 can be rotated by means of a workpiece rotation actuator. Linked to the rotation of the collet 6 is a rotary movement of the pipe 24*a*, held by the collet 6, around a workpiece axis of rotation 67 that extends in a perpendicular direction from the plane of projection in FIGS. 31 to 34. All movements are controlled by the computer based controller 18 of the pipe bending machine and are also feasible in analogous fashion with the devices illustrated in FIGS. 1 to 30.

Figures 31, 32, 33, 34:
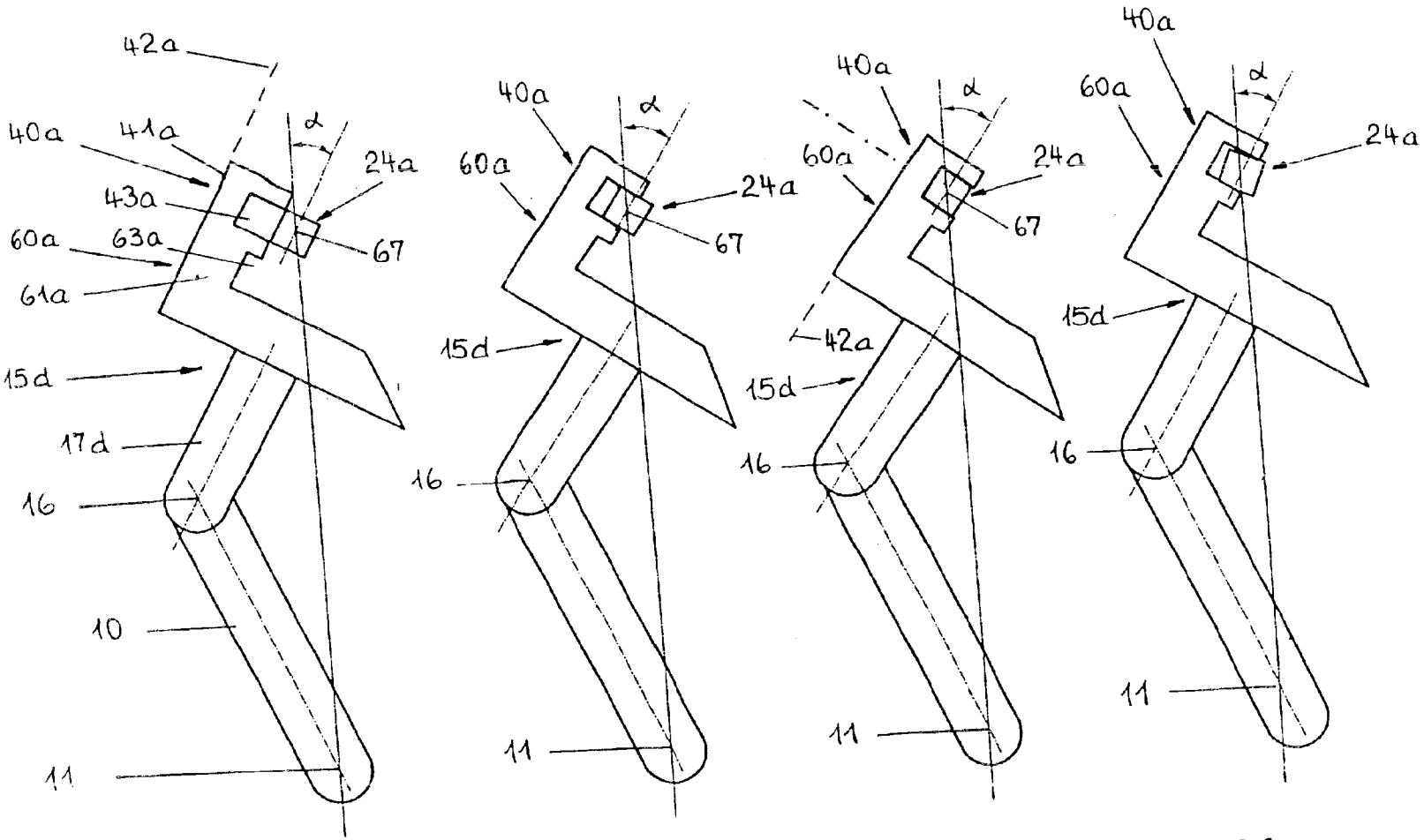
FIGS. 31 to 34 illustrate individual phases in the movement of another tool assembly relative to the workpiece.

FIG. 31 shows the overall system in an operating phase in which a preceding step in the processing of the pipe 24*a* has been completed and, by means of the upper bending tool 40*a* of the tool assembly 15*d*, a second processing step is to be performed. To that end, the bending tool 40*a* is open and, with mutually coordinated rotary movements of the tool holder 17*d* around the tool axis of rotation 16 and of the swivel support 10 around the swivel support axis of rotation 11, the bending die 41*a* is moved up close to the pipe 24*a*.

By a continued movement of the bending die 41*a* relative to the pipe 24*a* which remains stationary in the direction transverse to the workpiece axis of rotation 67, the pipe is inserted in the pipe channel 43*a* of the bending die 41*a*. Due to the implementation of the principle of two axes of rotation the swivel support axis of rotation 11, and the tool axis of rotation 16, the bending die 41*a* with its pipe channel 43*a* follows a path along which the orientation of the pipe channel 43*a* changes in comparison with the orientation in FIG. 31. In order to permit a reliable and especially non-skewed entry of the pipe 24*a* into the pipe channel 43*a*, it is necessary to change the orientation of the pipe 24*a* around the workpiece axis of rotation 67 to adapt its orientation to the reorientation of the pipe channel 43*a*. This is accomplished because the computer based controller of the pipe bending machine positively couples the reorientation of the pipe 24*a* to the reorientation of the pipe channel 43*a*, changing the orientation of the pipe 24*a* to the same degree as that of the pipe channel 43*a*.

FIGS. 31 to 33 illustrate the reorientation of the pipe 24*a* as a function of the changed angle of orientation $\alpha$ of the pipe 24*a*. FIG. 34 shows the conditions that would be encountered if the pipe 24*a* were not reoriented as indicated in FIGS. 31 to 33. It is readily obvious, that without reorientation around the workpiece axis of rotation 67, the pipe 24*a* would be skewed in the pipe channel 43*a* of the bending die 41*a*, which would, at the very least, complicate the positioning of the pipe 24*a* in the pipe channel 43*a* for processing. A similar problem would arise in the case of workpieces whose cross-sectional geometry deviates from the rectangular shape illustrated.

In FIG. 33 the pipe 24*a* is placed in its processing position in the pipe channel 43*a* which constitutes a work holder. The overall system is in the processing standby mode. The pipe 24*a* and the pipe channel 43*a* are each positioned around the workpiece axis of rotation 67 in a predefined orientation. Accordingly, the pipe 24 is oriented around the workpiece axis of rotation 67 that, in the subsequent processing step, the pipe is bent in the desired bending plane.

Following the operating state shown in FIG. 33, the bending tool 40*a* of the tool assembly 15*d* must now be closed by a corresponding movement of the associated clamping jaw. Thereupon, a swivel arm (not shown), equipped with the clamping jaws of the tool assembly 15*d*, can be rotated around the axis 42*a* while at the same time the bending die 41*a* is rotated around the axis 42*a*. As a result of this processing step, the pipe 24*a* will be bent in a bending plane that extends in a direction perpendicular to the axis 42*a* and indicated in FIG. 33 by a dot-dash line.

Upon completion of the second processing step, the bending tool 40*a* is opened and the pipe 24*a* removed from the pipe channel 43*a* as the pipe channel 43*a*, i.e., the bending die 41*a*, is moved in the transverse direction of the pipe. Following the condition of FIG. 33, this will initially lead to the operating state shown in FIG. 32 and then to the state shown in FIG. 31. Thus, the orientation of the pipe 24*a* around the workpiece axis of rotation 67 and the corresponding orientation of the pipe channel 43*a* are similarly changed for the removal of the pipe 24*a* from its processing position in the pipe channel 43*a*. The pipe 24*a* is reoriented to the same degree as the pipe channel 43*a*. Both reorientation functions are coupled by the control system. This positive coupling is not disengaged until the pipe 24*a* and the bending die 41*a* have been separated from each other. Once the positive coupling is disengaged, the individual orientation of the pipe 24*a* and that of the pipe channel 43*a* can again be independently varied.

Additional processing steps can be performed for so long as the pipe 24*a* remains clamped in the collet 6.

If the pipe 24*a* is to be bent once more along the same bending plane as in the preceding processing step using the tool 40*a* of the tool assembly 15*d*, it is necessary to first advance the pipe 24*a* by moving the collet 6 toward the front as viewed in FIGS. 31 to 34 before the movements outlined in FIGS. 31 to 33 are repeated.

If, on the other hand, the tool 40*a* of the tool assembly 15*d* is to produce another bend but along a bending plane other than that of the preceding processing step, the orientation of the pipe 24*a* must be changed in adaptation to the changed angle of the bending plane before the bending die 41*a* can be reapplied to the pipe 24*a*. This reorientation, required in addition to the reorientation of the pipe 24*a*, coordinated and positively coupled with the reorientation of the pipe channel 43*a*, can be made when the pipe 24*a* and the pipe channel 43*a* are not in contact. At that point, when the pipe channel 43*a* moving away from the pipe 24*a* is reoriented by virtue of the positively coupled reorientation of the pipe 24*a*, the additional reorientation causing a shift in the bending plane can be superimposed with the aid of the rotary workpiece actuator controlled by the programmable computer-based controller 18. Thereafter, if the bending die 41*a*, i.e., the pipe channel 43*a*, is moved back against the pipe 24*a*, the bending die 41*a*, i.e., the pipe channel 43*a*, will find the pipe 24*a* already in the desired orientation by virtue of which the pipe 24*a*, when moved into its processing position, will have the orientation specified for the desired new direction of the bending plane.

A reorientation of the pipe 24*a* in addition to its reorientation positively coupled with that of the pipe channel 43*a* will in any event be necessary whenever, after the pipe 24*a* has been processed with a bending tool 40*a* or 60*a* of the tool assembly 15*d*, another processing step is to be performed with the respective other bending tool 40*a* or 60*a*. This applies when the location of the bending plane of the preceding bending operation coincides with the location of the bending plane of the subsequent bending operation.

A reorientation of the type described may also be advisable when tool assemblies are used that differ in design from the tool assembly 15*d*, being identical for instance to the tool assemblies 15*a* as shown in FIGS. 2 to 13, and 15*c* as shown in FIGS. 22 to 30. In that case the collets or tool holders will be in the form of the pipe channels 23, 43, 63, 83, 103 of the bending dies 21, 41, 61, 81, 101. The bending tools 40*a*, 60*a* of the tool assembly 15*d* also lend themselves to the pick-up of workpieces to be processed in a work-holding position and the delivery of processed workpieces at a workpiece transfer station.

Thus, it can be seen from the foregoing detailed description and attached drawings that the novel bending machine of the present invention overcomes problems with the prior art machine and enables facile multiple bending of workpieces and machine loading and unloading of the workpiece.

Having thus described the invention, what is claimed is:

1. A bending machine for the bending of tubes, rods and bars (24, 24*a*), comprising a machine base unit (2); a collet (6) supported thereon for mounting a workpiece; a tool assembly (15, 15*a*, 15*b*, 15*c*, 15*d*) with at least one bending tool (20; 40, 60; 80, 100; 40*a*, 60*a*), said bending tool (20; 40, 60; 80, 100, 40*a*, 60*a*) opening and closing in the transverse direction of the workpiece by the relative movement of tool components (21, 25; 41, 45; 61, 65; 81, 85; 101, 105) to form at least one workpiece holder (23, 26; 43, 46; 63, 66; 83, 86; 103, 106); and a swivel support (10) mounted on the machine base unit (2) for rotation around a swivel support axis of rotation (ii) extending in the longitudinal direction (12) of the workpiece, said tool assembly (15, 15*a*, 15*b*, 15*c*, 15*d*) being supported on the swivel support (10) for rotation around a tool axis of rotation (16) extending in the longitudinal direction (12) of the workpiece, said swivel support axis of rotation (11) and the tool axis of rotation (16) being radially offset relative to one another and said tool axis of rotation (16) and the workpiece holder (23, 26; 43, 46; 63, 66; 83, 86; 103, 106), being radially offset relative to one another, rotation of the tool assembly (15, 15*a*, 15*b*, 15*c*, 15*d*) around the tool axis of rotation (16) and rotation of the swivel support (10) around the swivel support axis of rotation (11), moves a bending tool (20, 40, 60, 80, 100, 40*a*, 60*a*) into a workpiece pickup position for accepting a workpiece to be processed and/or into a workpiece transfer position for delivering a processed workpiece.

2. A bending machine in accordance with claim 1, wherein said swivel support (10) is in the form of a swivel arm.

3. The bending machine in accordance with claim 1 wherein said tool assembly (15*b*, 15*d*) includes multiple bending tools (40, 60; 40*a*, 60*a*) each comprising a bending die (41, 62; 41*a*, 61*a*) and a pressure element (45, 65), whereby the bending dies (41, 61; 41*a*, 61*a*) of different bending tools (40, 60; 40*a*, 60*a*) are positioned one above the other, each defining a different tool plane, and whereby rotation of the tool assembly (15*b*, 15*d*) around the tool axis of rotation (16) and rotation of the swivel support (10) around the swivel support axis of rotation (11), selectively move different bending tools (40, 60; 40*a*, 60*a*) into position for a bending operation.

4. The bending machine in accordance with claim 1 wherein the tool assembly (15) includes a plurality of bending tools (80, 100) consecutively positioned in the direction of rotation of the tool assembly (15*c*) around the tool axis of rotation (16), whereby rotation of the tool assembly (15*c*) around the tool axis of rotation (16) and rotation of the swivel support (10) around the swivel support axis of rotation (11) selectively moves different bending tools (80, 100) into position for a bending operation.

5. The bending machine in accordance with claim 1 wherein the tool assembly (15*c*) encompasses a plurality of bending tools (80, 100) each comprising one bending die (81, 101) and a clamping jaw (85, 105); wherein the bending dies (81, 101) are situated along a bending axis (82) extending in the transverse direction of the workpiece on both sides of the tool axis of rotation (16); wherein, for bending a workpiece with the workpiece mounted in the workpiece holder (83, 86; 103, 106), the bending dies (81, 101) and the clamping jaw or jaws (85, 105) can be rotated or swiveled around a bending axis (82); and wherein, by rotating the tool assembly (15*c*) around the tool axis of rotation (16) and rotating the swivel support (10) around the swivel support axis of rotation (11), the bending tools (80, 100) located on either side of the tool axis of rotation (16) can be selectively moved into position for a bending operation.

6. The bending machine in accordance with claim 1 wherein there is included a first rotary actuator for driving the rotational movement of the swivel support (10) around the swivel support axis of rotation (11) and/or the rotational movement of the tool assembly (15, 15*a*, 15*b*, 15*c*, 15*d*) with at least one bending tool (20; 40, 60, 80, 100, 40*a*, 60*a*) around the tool axis of rotation (16); a second rotary actuator for driving the rotational movement of the workpiece (24, 24*a*) clamped in the collet (6) around a workpiece axis of rotation (67) that extends in the longitudinal direction of the workpiece; a drive control for controlling both the rotary tool actuator and the rotary workpiece actuator; and wherein the workpiece (24, 24*a*), when placed in a processing position in the associated work holder (23, 43, 63; 83, 103; 43*a*, 63*a*) of a bending tool (20; 40, 60; 80, 100; 40*a*, 60*a*) an the associated work holder (23; 43, 63; 83, 103; 43*a*, 63*a*) when in the processing standby mode, have a Setpoint orientation around the workpiece axis of rotation (67), and wherein, with the rotary workpiece actuator and the rotary tool actuator controlled by the drive control, the workpiece (24, 24*a*) and the associated work holder (23; 43, 63; 83, 103; 43*a*, 63*a*) can be reoriented in correlated fashion relative to the setpoint orientation when the associated work holder (23; 43, 63; 83, 103; 43*a*, 63*a*) is moved for placing the workpiece (24, 24*a*) into its processing position in the associated work holder (23; 43, 63; 83, 103; 43*a*, 63*a*), and/or when the work holder (23; 43, 63; 83, 103; 43*a*, 63*a*) is moved for removing the workpiece (24, 24*a*) from its processing position in the associated work holder (23; 43, 63; 83, 103; 43*a*, 63*a*), with the orientation of the workpiece (24, 24*a*) being modifiable to the same degree as the orientation of the work holder (23; 43, 63; 83, 103; 43*a*, 63*a*).

7. The bending machine in accordance with claim 6 wherein the rotary too), actuator and the rotary workpiece actuator enable the associated work holder (23; 43, 63; 83, 103; 43*a*, 63*a*) to be moved relative to the workpiece (24, 24*a*) when that is moved for bringing the workpiece (24, 24*a*) into its processing position in the associated work holder (23; 43, 63; 83, 103; 43*a*, 63*a*) and/or when the workpiece (24, 24*a*) is removed from its processing position in the associated work holder (23; 43, 63; 83, 103, 43*a*, 63*a*) in an operating phase in which the workpiece (24, 24*a*) and the associated work holder (23; 43, 63; 83, 103; 43*a*, 63*a*) are not in contact with each other and in which, by means of the rotary workpiece actuator controlled by the drive control an additional reorientation can be superimposed on the reorientation of the workpiece (24, 24*a*), correlated with the reorientation of the work holder (23; 43, 63; 83, 103; 43*a*, 63*a*).

8. The bending machine in accordance with claim 1 wherein there is included a drive control in the form of a programmable computer-based controller (18).

9. A bending machine for the bending of tubes, rods and bars (24, 24*a*), comprising a machine base unit (2); a collet (6) supported thereon for mounting a workpiece; a tool assembly (15, 15*a*, 15*b*, 15*c*, 15*d*) with at least one bending tool (20; 40, 60; 80, 100; 40*a*, 60*a*), said bending tool (20; 40, 60; 80, 100; 40*a*, 60*a*) opening and closing in the transverse direction of the workpiece by the relative movement of tool components (21, 25; 41, 45; 61, 65, 81, 85; 101, 105) to form at least one workpiece holder (23, 26; 43, 46; 63, 66; 83, 86; 103, 106) and a swivel support (10) mounted on the machine base unit (2) for rotation around a swivel support axis of rotation (11) extending in the longitudinal direction (12) of the workpiece, said swivel support (10) being in the form of a swivel arm, said tool assembly (15, 15*a*, 15*b*, 15*c*, 15*d*) being supported on the swivel support (10) for rotation around a tool axis of rotation (16) extending in the longitudinal direction (12) of the workpiece, said swivel support axis of rotation (11) and the tool axis of rotation (16) being radially offset relative to one another and said tool axis of rotation (16) and the workpiece holder (23, 26; 43, 46; 63, 66; 83, 86; 103, 106), being radially offset relative to one another, said tool assembly (15*b*, 15*d*) including multiple bending tools (40, 60; 40*a*, 60*a*) each comprising a bending die (41, 61; 41*a*, 61*a*) and a pressure element (45, 65), and whereby rotation of the tool assembly (15*b*, 15*d*) around the tool axis of rotation (16) and rotation of the swivel support (10) around the swivel support axis of rotation (11), selectively move different bending tools (40, 60; 40*a*, 60*a*) into position for a bending operation, rotation of the tool assembly (15, 15*a*, 15*b*, 15*c*, 15*d*) around the tool axis of rotation (16) and rotation of the swivel support (10) around the swivel support axis of rotation (11), moves a bending tool (20; 40, 60, 80, 100, 40*a*, 60*a*) into a workpiece pickup position for accepting a workpiece to be processed and/or into a workpiece transfer position for delivering a processed workpiece.

10. The bending machine in accordance with claim 9 wherein the tool assembly (15*c*) encompasses a plurality of bending tools (80, 100) each comprising one bending die (81, 101) and, a clamping jaw (85, 105); wherein the bending dies (81, 101) are situated along a bending axis (82) extending in the transverse direction of the workpiece on both sides of the tool axis of rotation (16); wherein, for bending a workpiece, with the workpiece mounted in the workpiece holder (83, 86; 103, 106), the bending dies (81, 101) and the clamping jaw or jaws (85, 105) can be rotated or swiveled around a bending axis (82); and wherein, by rotating the tool assembly (15*c*) around the tool axis of rotation (16) and rotating the swivel support (10) around the swivel support axis of rotation (11), the bending tools (80, 100) located on either aide of the tool axis of rotation (16) can be selectively moved into position for a bending operation.

11. The bending machine in accordance with claim 9 wherein there is included a first rotary actuator for driving the rotational movement of the swivel support (10) around the swivel support axis of rotation (11) and/or the rotational movement of the tool assembly (15, 15*a*, 15*b*, 15*c*, 15*d*) with at least one bending tool (20; 40, 60, 80, 100, 40*a*, 60*a*) around the tool axis of rotation (16); a second rotary actuator for driving the rotational movement of the workpiece (24, 24*a*) clamped in the collet (6) around a workpiece axis of rotation (67) that extends in the longitudinal direction of the workpiece; a drive control fox controlling both the rotary tool actuator and the rotary workpiece actuator; and wherein the workpiece (24, 24*a*), when placed in a processing position in the associated work holder (23; 43, 63; 83, 103; 43*a*, 63*a*) of a bending tool (20; 40, 60; 80, 100; 40*a*, 60*a*) and the associated work holder (23; 43, 63; 83, 103; 43*a*, 63*a*) when in the processing standby mode, have a predefined setpoint orientation around the workpiece axis of rotation (67), and wherein, with the rotary workpiece actuator and the rotary tool actuator controlled by the drive control, the workpiece (24, 24*a*) and the associated work holder (23; 43, 63; 83, 103; 43*a*, 63*a*) can be reoriented in correlated fashion relative to the setpoint orientation when the associated work holder (23; 43, 63; 83, 103; 43*a*, 63*a*) is moved for placing the workpiece (24, 24*a*) into processing position in the associated work holder (23; 43, 63; 83, 103; 43*a*, 63*a*), and/or when the work holder (23; 43, 63; 83, 103; 43*a*, 63*a*) is moved for removing the workpiece (24, 24*a*) from its processing position in the associated work holder (23; 43, 63; 83, 103; 43*a*, 63*a*), with the orientation of the workpiece (24, 24*a*) being modifiable to the same degree as the orientation of the work holder (23; 43, 63; 83, 103; 43*a*, 63*a*).

12. A bending machine for the bending of tubes, rods and bars (24, 24*a*), comprising a machine base unit (2); a collet (6) supported thereon for mounting a workpiece; a tool assembly (15, 15*a*, 15*b*, 15*c*, 15*d*) with at least one bending tool(20; 40, 60; 80, 100; 40*a*, 60*a*), said bending tool (20; 40, 60; 80, 100; 40*a*, 60*a*) opening and closing in the transverse direction of the workpiece by the relative movement of tool components (21, 25; 41, 45; 61, 65; 81, 85; 101, 105) to form at least one workpiece holder (23, 26; 43, 46; 63, 66; 83, 86; 103, 106); and a swivel support (10) mounted on the machine base unit (2) for rotation around a swivel support axis of rotation (11) extending in the longitudinal direction (12) of the workpiece, said swivel support (10) being in the form of a swivel arm, said tool assembly (15, 15*a*, 15*b*, 15*c*, 15*d*) being supported on the swivel support (10) for rotation around a tool axis of rotation (16) extending in the longitudinal direction (12) of the workpiece, said swivel support axis of rotation (ii) and the tool axis of rotation (16) being radially offset relative to one another, and said tool axis of rotation (16) and the workpiece holder (23, 26; 43, 46; 63, 66; 83, 86; 103, 106), being radially offset relative to one another, the tool assembly (15*b*, 15*d*) including multiple bending tools (40, 60; 40*a*, 60*a*) each comprising a bending die (41, 61; 41*a*, 61*a*) and a pressure element (45, 65), the bending dies (41, 61; 41*a*, 61*a*) of different bending tools (40, 60, 40*a*, 60*a*) being positioned one above the other and each define a different tool plane, said bending tool (80, 100) being consecutively positioned in the direction of rotation of the tool assembly (15*c*) around the tool axis of rotation (16), whereby rotation of the tool assembly (15*c*) around the tool axis of rotation (16) and rotation of the swivel support (10) around the swivel support axis of rotation (11) selectively moves different bending tools (80, 100) into position for a bending operation, rotation of the tool assembly (15, 15*a*, 15*b*, 15*c*, 15*d*) around the tool axis of rotation (16) and rotation of the swivel support (10) around the swivel support axis of rotation (11), moves a bending tool (20; 40, 60, 80, 100, 40*a*, 60*a*) into a workpiece pickup position for accepting a workpiece to be processed and/or into a workpiece transfer position for delivering a processed workpiece.

13. The bending machine in accordance with claim 12 wherein the tool assembly (15*c*) encompasses a plurality of bending tools (80, 100) each comprising one bending die (81, 101) and a clamping jaw (85, 105), wherein the bending dies (81, 101) are situated along a bending axis (82) extending in the transverse direction of the workpiece on both sides of the tool axis of rotation (16); and wherein, for bending a workpiece with the workpiece mounted in the workpiece holder (83, 86; 103, 106), the bending dies (81, 101) and the clamping jaw or jaws (85, 105) can be rotated or swiveled around a bending axis (82); and wherein, by rotating the tool assembly (15*c*) around the tool axis of rotation (16) and rotating the swivel support (10) around the swivel support axis of rotation (11), the bending tools (80, 100) located on either side of the tool axis of rotation (16) can be selectively moved into position for a bending operation.

* * * * *